US010176960B2

(12) United States Patent
Busta et al.

(10) Patent No.: US 10,176,960 B2
(45) Date of Patent: Jan. 8, 2019

(54) DEVICES AND METHODS FOR ENHANCING THE COLLECTION OF ELECTRONS

(71) Applicant: Elwha LLC, Bellevue, WA (US)

(72) Inventors: Heinz Hermann Busta, Park Ridge, IL (US); Richard M. Gorski, Arlington Heights, IL (US); Max N. Mankin, Seattle, WA (US); Tony S. Pan, Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 0 days.

(21) Appl. No.: 15/482,019

(22) Filed: Apr. 7, 2017

(65) Prior Publication Data

US 2018/0294133 A1 Oct. 11, 2018

(51) Int. Cl.

| | |
|---|---|
| ***H01J 29/46*** | (2006.01) |
| ***H01J 29/58*** | (2006.01) |
| ***H01J 31/06*** | (2006.01) |
| ***H01J 19/32*** | (2006.01) |
| ***H01J 19/04*** | (2006.01) |
| ***H01J 19/38*** | (2006.01) |

(52) U.S. Cl.

CPC ..... *H01J 29/58* (2013.01); *H01J 19/04* (2013.01); *H01J 19/32* (2013.01); *H01J 19/38* (2013.01); *H01J 31/06* (2013.01)

(58) Field of Classification Search

USPC ..... 313/449, 495, 310, 336

See application file for complete search history.

(56) References Cited

U.S. PATENT DOCUMENTS

| | | | | |
|---|---|---|---|---|
| 4,874,981 | A | 10/1989 | Spindt | |
| 5,543,691 | A | 8/1996 | Palevsky et al. | |
| 5,877,597 | A * | 3/1999 | Beeteson | G09G 1/20 313/422 |
| 8,575,842 | B2 | 11/2013 | Hyde et al. | |
| 8,946,992 | B2 | 2/2015 | Cheatham, III et al. | |
| 2005/0258739 | A1 | 11/2005 | Park et al. | |
| 2007/0024180 | A1 | 2/2007 | Choi et al. | |
| 2015/0022076 | A1 * | 1/2015 | Ulisse | H01J 1/3042 313/308 |

OTHER PUBLICATIONS

PCT International Search Report; International App. No. PCT/US2018/025999; dated Jul. 20, 2018; pp. 1-3.

* cited by examiner

*Primary Examiner* — Vip Patel

(57) ABSTRACT

The present disclosure relates to devices and methods for enhancing the collection of charge carriers, such as electrons. Methods of manufacturing the devices are also disclosed. An electronic device can include a cathode, an anode, a gate electrode, and a focus electrode. The cathode can include a cathode substrate and an emitting region that is configured to emit an electron flow. The anode can include an anode substrate and a collection region that is configured to receive and/or absorb the electron flow. The gate electrode can be receptive to a first power source to produce a voltage in the gate electrode that is positively-biased with respect to the cathode. The focus electrode can be receptive to a second power source to produce a voltage in the focus electrode that is negatively-biased with respect to the gate electrode and/or the cathode.

35 Claims, 9 Drawing Sheets

DEVICES AND METHODS FOR ENHANCING THE COLLECTION OF ELECTRONS

If an Application Data Sheet ("ADS") has been filed on the filing date of this application, it is incorporated by reference herein. Any applications claimed on the ADS for priority under 35 U.S.C. §§ 119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications, or claims benefits under 35 U.S.C. § 119(e) for provisional patent applications, for any and all parent, grandparent, great-grandparent, etc. applications of the Priority Application(s)).

PRIORITY APPLICATIONS

None.

If the listings of applications provided above are inconsistent with the listings provided via an ADS, it is the intent of the Applicant(s) to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

TECHNICAL FIELD

The present disclosure relates to devices and methods for enhancing the collection of charge carriers. More specifically, the present disclosure relates to devices and methods for enhancing the collection of electrons. Methods of manufacturing the devices are also disclosed.

SUMMARY

The present disclosure relates to devices and methods for enhancing the collection of charge carriers, such as electrons. Methods of manufacturing the devices are also disclosed. In one embodiment, an electronic device includes a cathode, an anode, a gate electrode, and a focus electrode. The cathode can include a cathode substrate and an emitting region that is configured to emit an electron flow. The anode can include an anode substrate and a collection region that is configured to receive and/or absorb the electron flow. The gate electrode can be disposed between the cathode and the anode, and can be receptive to a first power source to produce a voltage in the gate electrode that is positively-biased with respect to the cathode. The focus electrode can also be disposed between the cathode and the anode, and can be receptive to a second power source to produce a voltage in the focus electrode that is negatively-biased with respect to the gate electrode and in most instances also negatively-biased with respect to the cathode (in some instances, the focus electrode may be positively-biased with respect to the cathode and negatively-biased with respect to the gate electrode). The gate electrode and the focus electrode (and/or the associated electric fields created by the voltages therein) can further be configured to control or modulate the electron flow. For example, the gate electrode and focus electrode can each be configured to exert a force on the electron flow.

In one embodiment, an electronic device includes a cathode, an anode, and a gate electrode. The cathode can include a cathode substrate and an emitting region that is configured to emit an electron flow. The anode can include an anode substrate and a collection region that is configured to receive or absorb the electron flow. The gate electrode can be disposed between the cathode and the anode, and can be receptive to a first power source to produce a voltage in the gate electrode that is positively-biased with respect to the cathode. The collection region can include a concave surface having a curvature (e.g., a radius of curvature) that is selected to increase the number of electrons that are received or absorbed by the collection region. For example, the curvature can be selected to increase the number of electrons that impact (or impinge) the concave surface at an angle that is substantially perpendicular to the concave surface. In some instances, the curvature of the concave surface can create an electric field that influences the trajectories of the electrons.

In one embodiment, an electronic device includes a cathode and an anode. The cathode can include a cathode substrate and an emitting region that is configured to emit an electron flow. The anode can include an anode substrate and a collection region that is configured to receive or absorb the electron flow. The width of the emitting region can be less than the width of the cathode substrate such that the emitting region is limited to a portion of the cathode. The width of the emitting region can also define or impact the width of the electron flow. Further, the emitting region can be aligned (or spatially aligned) with the collection region of the anode, such that the electron flow is emitted from the emitting region and directed towards the collection region.

In another embodiment, the disclosure relates to methods of manufacturing electronic devices. In one embodiment, a method of manufacturing an electronic device includes depositing or disposing one or more emitting regions onto a surface of a cathode substrate. The method can also include a step of depositing or disposing a support member (which can include an insulating material) onto a surface of an anode substrate, and forming one or more openings in the support member thereby exposing one or more portions of the anode substrate. The method can further include a step of depositing, disposing, or forming one or more collection regions onto the one or more exposed portions of the anode substrate. In certain instances, the method also includes steps of depositing or disposing one or more gate electrodes onto a surface of the support member, and depositing or disposing one or more focus electrodes onto the surface of the support member.

In another embodiment, the disclosure relates to methods of using the electronic devices to collect electrons. In one embodiment, a method of collecting electrons at an anode includes a step of obtaining an electronic device including a cathode including a cathode substrate and an emitting region that is configured to emit an electron flow; an anode including an anode substrate and a collection region that is configured to receive or absorb the electron flow; a gate electrode disposed between the cathode and the anode, wherein the gate electrode is receptive to a first power source to produce a voltage in the gate electrode; and a focus electrode disposed between the cathode and the anode, wherein the focus electrode is receptive to a second power source to produce a voltage in the focus electrode. The method can further include steps of applying a voltage to the gate electrode that is positively-biased relative to the cathode; and applying a voltage to the focus electrode that is negatively-biased relative to the gate electrode and/or the cathode. The method can also include a step of emitting an electron flow from the emitting region of the cathode, wherein the gate electrode accelerates the electron flow between the cathode and the gate electrode, and wherein the focus electrode forces the electron flow away from the gate electrode and directs and/or steers the electron flow towards the collection region of the anode. Additional embodiments are further disclosed below.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The written disclosure herein describes illustrative embodiments that are non-limiting and non-exhaustive. Reference is made to certain of such illustrative embodiments that are depicted in the figures, in which.

DETAILED DESCRIPTION

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Thus, the following detailed description of the embodiments of the disclosure is not intended to limit the scope of the disclosure, as claimed, but is merely representative of possible embodiments. In addition, the steps of a method do not necessarily need to be executed in any specific order, or even sequentially, nor do the steps need to be executed only once.

The present disclosure relates to devices and methods for enhancing the collection of charge carriers, such as electrons. Methods of manufacturing the devices are also disclosed. While the disclosure herein is primarily directed towards the emission and collection of electrons, it will be appreciated that the principles of the disclosure can also be applicable to other types of charge carriers, their emission sources, and the collection thereof. Further, it will also be appreciated that the collection of electrons as disclosed herein can, in some embodiments, generally follow the principles of inverse quantum tunneling. However, such principles shall not limit the scope of the disclosure in any way.

Figure 1:
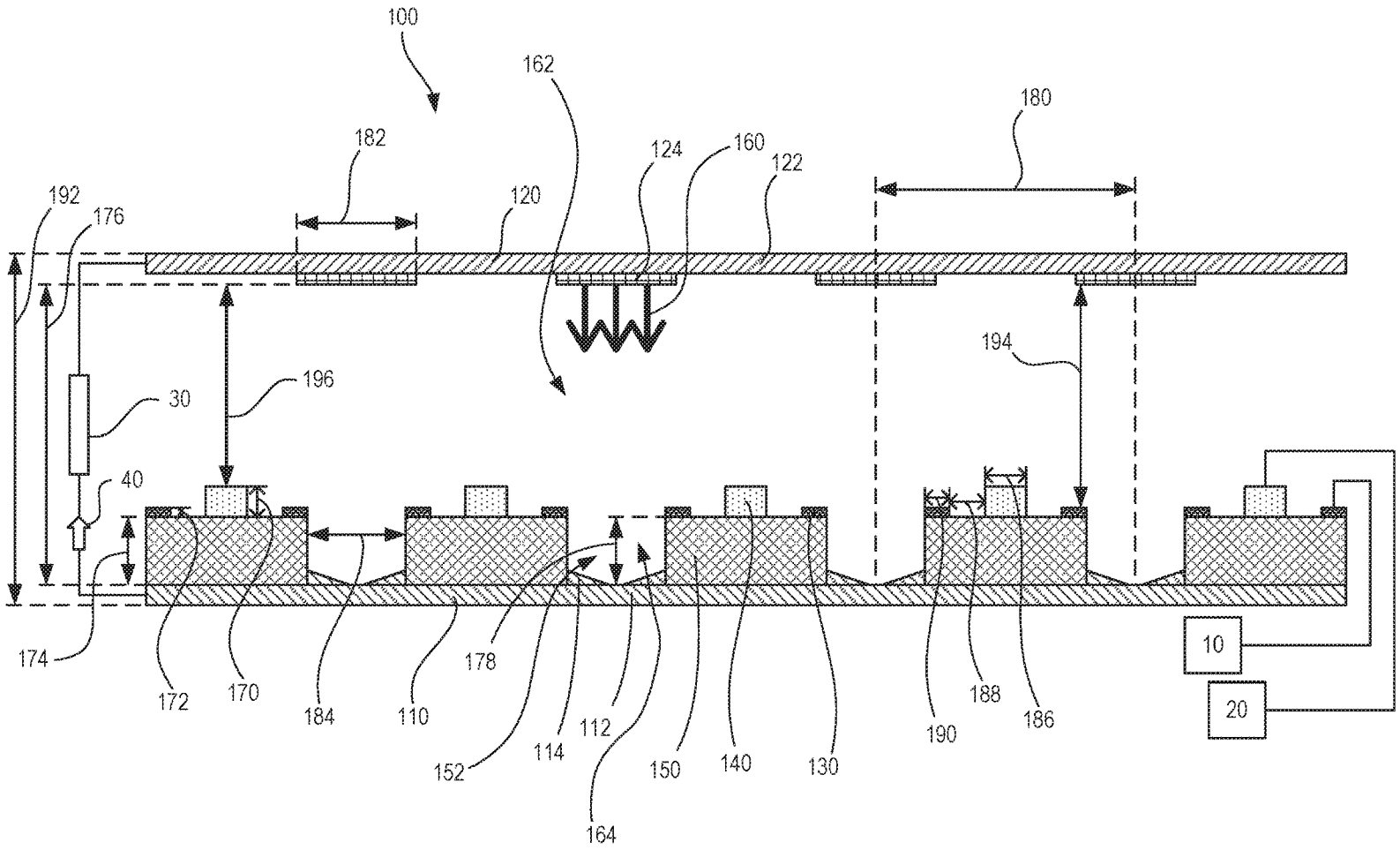
FIG. 1 is a schematic illustration of an electronic device in accordance with an embodiment of the present disclosure.

FIG. 1 depicts an illustrative electronic device or apparatus 100, according to one embodiment of the present disclosure. As shown in FIG. 1, the electronic device 100 can include an anode 110, a cathode 120, a gate electrode 130, and a focus electrode 140. In conventional usage, the term cathode refers to an electron emitter, and the term anode refers to an electron receiver. It will, however, be appreciated that in the electronic devices 100 described herein, the cathode 120 and anode 110 may each act as an electron emitter or an electron receiver. For example, under appropriate biasing voltages, an electron flow 160 (or another charge carrier flow) may be established between the cathode 120 and the anode 110, or between the anode 110 and cathode 120, of the electronic device 100.

As shown in FIG. 1, in some embodiments, the anode 110 is arranged such that it is substantially parallel to the cathode 120. Further, the gate electrode 130 and the focus electrode 140 (which can also be described as a gate grid 130 and a focus grid 140) are disposed or positioned between the anode 110 and cathode 120. In certain embodiments, the gate electrode 130 and/or the focus electrode 140 can also be arranged such that they are substantially parallel to the anode 110 and cathode 120. As further detailed below, an electron flow 160 can be emitted by and travel from the cathode 120 to the anode 110, as indicated by reference arrows 160. Further, the electron flow 160 can be controlled, modulated, and/or otherwise influenced by the gate electrode 130 and/or the focus electrode 140. For example, the gate electrode 130 can be configured to exhibit a force or an electric field that accelerates the electron flow 160 in the space 162 between the cathode 120 and the gate electrode 130. The gate electrode 130 can further be configured to exhibit a force or an electric field that decelerates the electron flow 160 in the space 164 between the gate electrode 130 and the anode 110. The focus electrode 140 can be configured to exhibit a force or electric field that directs the electron flow 160 away from the gate electrode 130 and towards the anode 110 (or collection region 114).

In certain embodiments, the gate electrode 130 and/or the focus electrode 140 can be disposed on or in close proximity to the anode 110. In some of such embodiments, the gate electrode 130 and/or the focus electrode 140 are closer to the anode 110 than the cathode 120. For example, the gate electrode 130 and/or the focus electrode 140 can be disposed such that the distance between the gate electrode 130 (and/or the focus electrode 140) and the anode 110 is less than the distance between the gate electrode 130 (and/or the focus electrode 140) and the cathode 120.

The anode 110 can include various materials, including but not limited to tungsten, tantalum, lanthanum, lanthanum hexaboride, cerium, cerium hexaboride, barium, barium carbonate, barium oxide, cesium, silicon, doped silicon, and/or mixtures thereof. Other materials can also be used.

In some embodiments, the anode 110 includes an anode substrate 112 and a collection region 114. The collection region 114 can be configured to receive, absorb, and/or collect an electron flow 160 that is emitted from the cathode 120. For example, while not being bound by theory, the electron flow 160 may be absorbed by the collection region 114 in accordance with principles of inverse quantum tunneling.

In some embodiments, such as the embodiment of FIG. 1, the collection region 114 is raised above or otherwise extends outwards from the anode substrate 112. In certain embodiments, the width 184 of the collection region 114 can be less than the width of the anode substrate 112, such that the collection region 114 is limited to a portion of the anode substrate 112 (as is shown in FIG. 1). In other words, the collection region 114 can be disposed such that it does not cover the entirety of the anode substrate 112.

Figure 4:
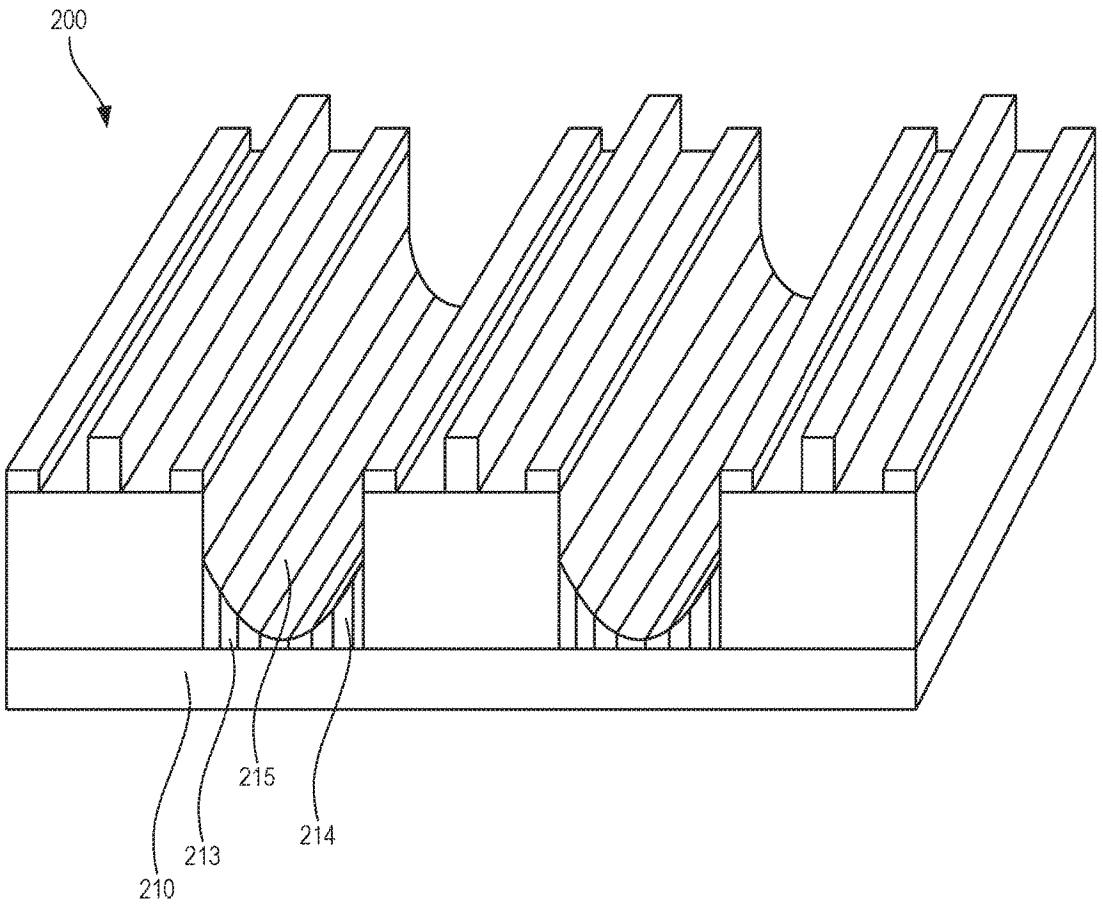
FIG. 4 is a perspective view of a portion of an electronic device in accordance with another embodiment of the present disclosure.

As further shown in FIG. 1, the collection region 114 of the anode 110 can include a concave surface. In some embodiments, the concave surface can be directed or disposed towards the cathode 120 (or the emitting source of the electron flow 160). In certain embodiments, the collection region 114 includes a substantially smooth, curved concave surface. The collection region 114 can also be composed of a plurality of individual segments that together form a concave shape or surface. For example, the height of adjacent segments can be varied to form a substantially concave shape or surface (as is shown in FIG. 4).

In certain embodiments, the surface curvature of the collection region 114 is configured and/or selected to increase and/or maximize the collection of electrons. For example, the surface curvature, such as the radius of curvature of the concave surface, can be configured and/or selected to increase and/or maximize the number of electrons that impact (or impinge) the surface at a perpendicular or substantially perpendicular angle. For instance, an electron flow 160 can include a plurality of electrons having various trajectories. While the trajectories can generally be directed from the cathode 120 towards the anode 110, the trajectories of individual electrons may not be parallel with one another. For example, as shown in the simulations depicted in FIGS. 7 and 9, trajectories of individual electrons can be non-linear and different from another. In such instances, the surface curvature of the collection region 114 can be configured and/or selected according to the trajectories of the electrons.

In particular embodiments, an electric field is also produced at the surface of the collection region 114 and/or between the collection region 114 and the gate electrode 130. For example, a voltage potential generated in the gate electrode 130 can be large enough and the distance 178 between the gate electrode 130 and collection region 114 small enough to produce an electric field at the surface of the collection region 114. In some instances, an electric field of up to about 0.4 V/nm can be produced or exhibited by the collection region 114. The strength of this electric field (or the force exerted by the electric field) can increase the probability that an impacting (or impinging) electron will be absorbed by and/or otherwise collected by the collection region 114, e.g., via quantum tunneling. The direction of this electric field (or the force exerted by the electric field) can increase the probability that an impacting (or impinging) electron will be absorbed by and/or otherwise collected by the collection region 114, e.g., via directing and/or steering electrons to impact the surface of the collection region 114 at a perpendicular angle.

For example, in certain embodiments, the concave surface of the collection region 114 can create a curvature to the electric field between the gate electrode 130 and the anode 110. This curvature in the electric field can influence (or impart a force on) the electrons and/or their trajectories, causing them to travel toward the collection region 114 at an angle that is substantially perpendicular to the surface. In such embodiments, the probability that an impacting (or impinging) electron will be absorbed by and/or otherwise collected by the collection region 114 can be increased and/or maximized. Without being bound by any particular theory, when an electron impacts the surface of the collection region 114 at a perpendicular or substantially perpendicular angle, the majority of the electron's kinetic energy is used to overcome the potential barrier set by the anode's surface work function, thus increasing the likelihood that the electron will be absorbed into the collection region 114. A curved electric field created between the collection region 114 and the gate electrode 130 can also deflect electrons away from a sidewall of a support member 150 that is disposed between the gate electrode 130 and the collection region 114, preventing the sidewall from being charged and disturbing the electric field.

The cathode 120 can also include various materials, including but not limited to tungsten, tantalum, molybdenum, rhenium, osmium, platinum, nickel, lanthanum, lanthanum hexaboride, cerium, cerium hexaboride, barium, barium carbonate, barium oxide, cesium, and/or mixtures thereof. Other materials can also be used.

In some embodiments, the cathode 120 includes a cathode substrate 122 and an emitting region 124. The emitting region 124 can be configured to emit an electron flow 160. For example, in some embodiments, the cathode 120, cathode substrate 122, and/or the emitting region 124 can be heated to thermionic emission temperature (e.g., between about 1000 K and 2000 K) by an external heat source to induce emission of an electron flow 160. In such embodiments, the cathode 120 can be referred to as a thermionic cathode. As can be appreciated, the emission temperature can also be referred to as the operational or operating temperature.

In further embodiments, the operational temperature of the cathode 120, cathode substrate 122, and/or the emitting region 124 is dependent upon the material used, and particularly the material used in the emitting region 124. The operational temperature of the cathode 120, cathode substrate 122, and/or the emitting region 124 can also be dependent upon the type of electronic device. For example, in embodiments where the electronic device 100 operates by cold field emission, the operating temperature of the cathode 120, cathode substrate 122, and/or the emitting region 124 can be approximately room temperature (e.g., about 273 K). In embodiments where the electronic device 100 operates by thermionic emission or Schottky emission, the operating temperature of the cathode 120, cathode substrate 122, and/or the emitting region 124 can be greater than about 1000 K, or greater than about 1073 K (or 800° C., common operational temperatures for barium oxide cathodes).

Figure 3:
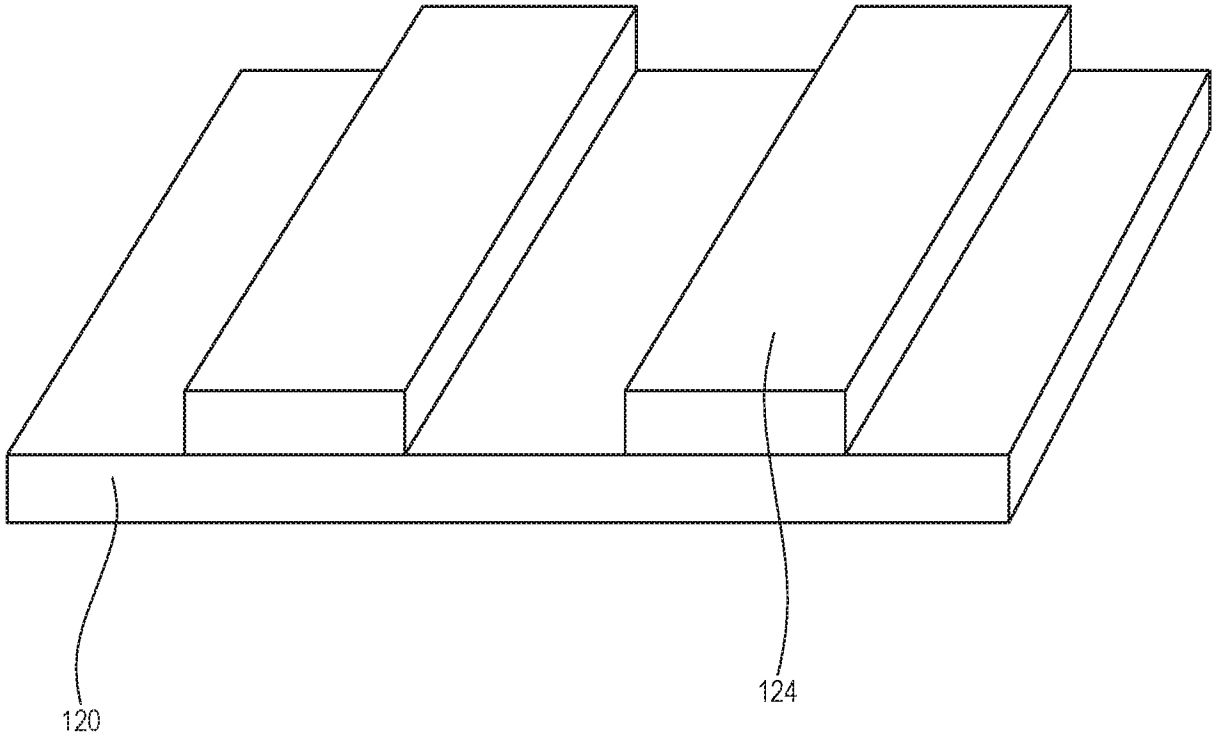
FIG. 3 is a perspective view of another portion of the electronic device represented by FIG. 1.

In some embodiments, such as the embodiment of FIG. 1, a plurality of emitting regions 124 are disposed on the surface of the cathode substrate 122. For example, one or more strips or segments of emitting regions 124 can be disposed on the surface of the cathode substrate 122 (as is shown in FIG. 3). In certain of such embodiments, the one or more emitting regions 124 are arranged and/or aligned (e.g., spatially aligned) with one or more collection regions 114 of the anode 110. Further, in some instances, the width 182 of the emitting regions 124 can be configured to be substantially equal to the width 184 of the collection regions 114. The width 182 of the one or more emitting regions 124 can also be less than the width of the cathode substrate 122, such that each emitting region 124 is limited to a portion of the cathode substrate 122 (as is shown in FIG. 1). In other words, the emitting region 124 can be disposed such that it does not cover the entirety of the cathode substrate 122. In yet other embodiments, the emitting region 124 can cover the entirety or substantially all of the surface of the cathode substrate 122.

Each of the gate electrode 130 and/or the focus electrode 140 can include one or more metals, including but not limited to aluminum, molybdenum, tungsten, nickel, copper, platinum, gold, and/or mixtures thereof. Other types of conductive materials can also be used, including but not limited to carbon nanotubes and graphene. In certain embodiments, the gate electrode 130 and/or the focus electrode 140 are mounted on and/or otherwise supported by a support member 150 (which can include an insulating material, such as an electrical insulating material).

The support member 150 can be configured to electrically insulate and/or isolate the gate electrode 130 and/or the focus electrode 140 from the anode 110 and/or the cathode 120. In some embodiments, the support member 150 includes one or more insulating materials. Exemplary insulating materials 150 that can be used include but are not limited to silicon, silicon nitride, silicon oxide, aluminum oxide, and/or mixtures thereof. Other materials can also be used.

As shown in FIG. 1, in some embodiments the support member 150 can be deposited or otherwise disposed on the anode 110 (or anode substrate 112). The gate electrode 130 and/or the focus electrode 140 can then be deposited or otherwise disposed on the support member 150 such that the gate electrode 130 and/or the focus electrode 140 are spaced away from the anode 110 (or anode substrate 112). In other words, the support member 150 can be described as being sandwiched by the anode 110 and the gate and focus electrodes 130, 140. Further, the support member 150 can be disposed such that the gate electrode 130 and/or the focus electrode 140 do not directly contact the anode 110 (or anode substrate 112). In some embodiments, the gate and/or focus electrodes 130, 140 are disposed such that they are closer to the anode 110 than the cathode 120.

Figure 2:
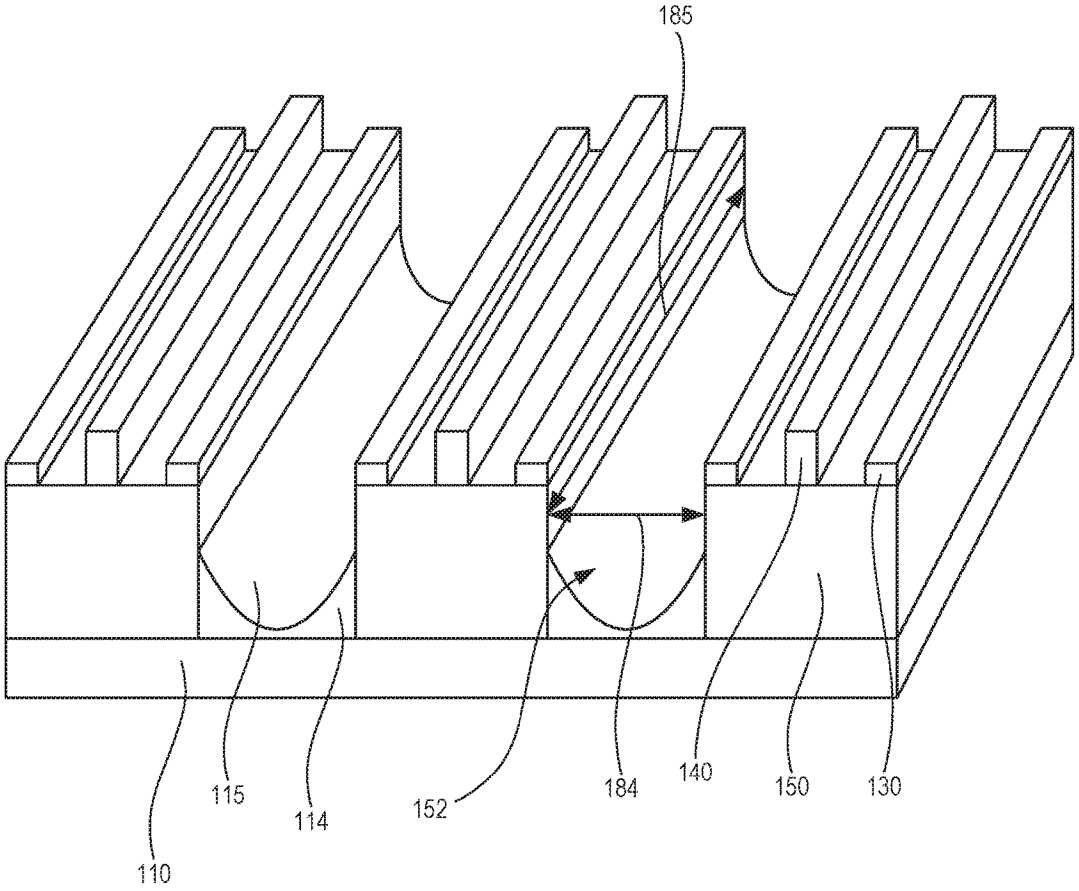
FIG. 2 is a perspective view of a portion of the electronic device represented by FIG. 1.

With continued reference to FIG. 1, one or more portions of the support member 150 can be removed to form one or more openings 152. In some embodiments, the openings 152 form elongated slits (as is shown in FIG. 2). The one or more openings 152 can align with, expose, or otherwise provide access to the anode 110 (or to the collection region 114). In other words, the one or more openings 152 can provide a pathway for an electron flow 160 to travel to the anode 110 or to the collection region 114. In certain embodiments, the one or more openings 152 can be cut into the support member 150. Other methods can also be employed to remove the portions of support member 150 and expose the anode 110 or collection region 114.

As further shown in FIG. 1, in some embodiments, the gate electrode 130 and the focus electrode 140 can be deposited or otherwise disposed on a first and second side (or either side) of the openings 152. In certain embodiments, disposing the gate electrode 130 and focus electrode 140 on both sides of the openings 152 can be advantageous in directing the electron flow 160 towards the collection region 114 of the anode 110.

As previously mentioned, the gate electrode 130 and/or focus electrode 140 can be configured to control or modulate the electron flow 160. During operation of the electronic device 100, for example, the gate electrode 130 and/or the focus electrode 140 can each be receptive to a power source 10, 20 that is configured to produce a positive or negative voltage bias. In the illustrated embodiment of FIG. 1, for example, the gate electrode 130 is receptive to a first power source 10 (e.g., a gate power source) that is configured to produce a first voltage in the gate electrode 130. The focus electrode 140 is receptive to a second power source 20 (e.g., a focus power source) that is configured to produce a second voltage in the focus electrode 140.

The voltages produced in each of the gate electrode 130 and focus electrode 140 can be positively or negatively charged as desired. Further, in some embodiments, at least one voltage is positively charged and at least one voltage is negatively charged. For example, in certain embodiments, a voltage produced in the gate electrode 130 is positively-biased relative to the cathode 120, and a voltage produced in the focus electrode 140 is negatively-biased relative to the cathode 120. In other words, the first power source 10 can be configured to provide the gate electrode 130 with a positive voltage potential, such as between about +1 V and about +100 V, relative to the cathode 120; and the second power source 20 can be configured to provide the focus electrode 140 with a negative voltage potential, such as between about −1 V and about −100 V, relative to the cathode 120.

A positively-biased voltage in the gate electrode 130 can create an electric field that attracts the electron flow 160 being emitted from the cathode 120 such that it is accelerated towards the collection region 114 of the anode 110 while in the space 162 between the cathode 120 and the gate electrode 130. In certain embodiments, the voltage of the gate electrode 130 can also be positively-biased relative to the anode 110, such that an electric field can be created that causes the electron flow 160 to decelerate while in the space 164 between the gate electrode 130 and the anode 110.

Further, in some instances, a positively-biased voltage in the gate electrode 130 can create an electric field that attracts at least a portion of the electron flow 160 (e.g., one or more individual electrons) being emitted from the cathode 120 such that it is accelerated towards the gate electrode 130. In certain of such embodiments, it may be desirous to deflect or otherwise direct the electron flow 160 away from the gate electrode 130 such that an increased and/or maximum number of individual electrons continue traveling towards the collection region 114 of the anode 110. In such embodiments, a negatively-biased voltage in the focus electrode 140 (e.g., negatively-biased voltage with respect to the gate electrode 130 and/or the cathode 120) can aid in directing the electron flow 160 away from the gate electrode 130 and towards the collection surface 114 of the anode 110. For example, a negatively-biased voltage in the focus electrode 140 (e.g., negatively-biased voltage with respect to the gate electrode 130 and/or the cathode 120) can force, steer, and/or deflect the electron flow 160 away from the gate electrode 130, causing the electron flow 160 to remain narrow or otherwise focused and continue traveling towards the collection region 114 of the anode 110.

In other words, the electric fields that are created between the cathode 120, anode 110, and gate and focus electrodes 130, 140 can accelerate an incoming electron flow 160 towards the gate electrode 130, focus or otherwise direct the electron flow 160 into the opening 152 while forcing or deflecting the electron flow 160 away from the gate electrode 130, and then decelerate the electron flow 160 as it approaches the collection region 114 of the anode 110. Since the electron flow 160 is forced or directed away from the gate electrode 130, undesired and/or unwanted gate current can be minimized and/or made zero, and minimal to zero power is dissipated by the gate electrode 130.

In embodiments where the electronic device 100 is configured to generate electrical power, the anode 110 can also be negatively-biased (or have a negative voltage potential (e.g., between about 0.1 V and about 0.5 V)) relative to the cathode 120 such that an electron current 40 can flow from the anode 110 back to the cathode 120 and/or provide power to a load 30.

With continued reference to FIG. 1, in some embodiments, the focus electrode 140 can be deposited or otherwise disposed on the support member 150 such that it has a thickness 170 (or height) that is greater than the thickness 172 (or height) of the gate electrode 130. Increasing the thickness 170 of the focus electrode 140 can decrease the distance 196 between the focus electrode 140 and the cathode 120. Further, in some of such embodiments, the distance 196 between the focus electrode 140 and the cathode 120 can be less than the distance 194 between the gate electrode 130 and the cathode 120. In other words, the distance 194 between the gate electrode 130 and the cathode 120 can be greater than the distance 196 between the focus electrode 140 and the cathode 120. In some embodiments, the focus electrode 140 can be described as being disposed between the cathode 120 and the gate electrode 130.

Further, the focus electrode 140 can be deposited or otherwise disposed on the support member 150 such that it is located between two gate electrodes 130 (or two portions of the gate electrode 130). For example, as shown in FIG. 1, the focus electrode 140 is disposed such that it is substantially centered on the support member 150. The gate electrode 130 is deposited or otherwise disposed on first and second sides of the focus electrode 140. Further, the gate electrode 130 is deposited or otherwise disposed such that it is closer to the openings 152 than the focus electrode 140. As can be appreciated, the width 190 of the gate electrode 130, the width 186 of the focus electrode 140, and the distance 188 between the gate electrode 130 and the focus electrode 140 can be varied based on the size of the device 100 and other parameters.

The thickness 192 of the electronic device 100 can vary, as can the distance 176 between the emitting region 124 of the cathode 120 and the collection region 114 of the anode 110. For example, in some embodiments the thickness 192 of the electronic device 100 from the cathode 120 to anode 110 is less than about 500 microns, or between about 0.5 and about 500 microns. In other embodiments, the thickness 192 of the electronic device 100 is between about 1 and about 250 microns, between about 1 and about 100 microns, between about 1 and about 10 microns, or between about 1 and about 5 microns. In other embodiments, the electronic device 100 can be defined in terms of the distance 176 between the emitting region 124 of the cathode 120 and the collection region 114 of the anode 110. For example, in some of such embodiments the distance 176 between the cathode 120 and the anode 110 is less than about 500 microns, or between about 0.5 and about 500 microns. In other embodiments, the distance 176 is between about 1 and about 250 microns, between about 1 and about 100 microns, between about 1 and about 10 microns, or between about 1 and about 5 microns.

As can be appreciated, in embodiments where the thickness 192 (and/or distance 176) of the electronic device 100 is relatively large, the cathode 120 can include emitting regions 124 that are relatively large. For example, in such embodiments, the emitting regions 124 can cover, or substantially cover, most of the cathode substrate 122. In other embodiments, such as embodiments where the thickness 192 of the electronic device 100 is relatively small, the cathode 120 can include emitting regions 124 having a relatively smaller width 182.

Other parameters of the electronic device 100 can also be varied, at least in part, depending on the desired size of the electronic device 100. For example, in some embodiments, the thickness 174 of the support member 150 can be made larger or smaller. In certain embodiments, the width 184 of the opening 152 and/or collection surface 114 can also be made larger or smaller. Further, in some embodiments, the width 182 of the emitting regions 124 can be equal to, or substantially equal to the width 184 of the openings 152 and/or the collection surface 114 of the anode 110. As shown in FIG. 1, in certain embodiments, the emitting region 124, the opening 152, and the collection region 114 can also be substantially aligned (or spatially aligned) with one another.

In further embodiments, the width 182 of the emitting region 124 is selected such that is less than the distance 180 between adjacent collection regions 114 (which can be defined as the period of the electronic device 100). The width 182 of the emitting region 124 can also be selected to limit the width of the electron flow 160 emitted from the emitting region 124. Limiting the width of the electron flow 160 can aid in providing a narrower and more focused flow 160 or beam for deliverance into the opening 152 and away from the gate electrode 130.

In some embodiments, the electronic device 100 is further encased in a container, which may isolate the anode 110, cathode 120, gate electrode 130, and focus electrode 140 in a controlled environment, such as a vacuum or gas-filled region. The gas used to fill the container may include one or more atomic or molecular species, partially ionized plasmas, fully ionized plasmas, or mixtures thereof. A gas composition and pressure in the container may also be chosen to be conducive to the passage of the electron flow 160 between the cathode 120 and the anode 110. The gas composition, pressure, and ionization state in the container may also be chosen to be conducive to the neutralization of space charges for electron flow between the cathode 120 and the anode 110. The gas pressure in the container may, as in conventional vacuum tube devices, be substantially below atmospheric pressure. The gas pressure may be sufficiently low, so that the combination of low gas density and small inter-component separations reduces the likelihood of gas interactions with transiting electrons to low enough levels such that a gas-filled device offers vacuum-like performance. In some embodiments, the electronic device 100 is a vacuum electronic device, such that the electron flow 160 travels from the cathode 120 to the anode 110 through a vacuum region.

The electronic device 100 (which may be a vacuum electronic device) may also be used in various ways. For example, the electronic device 100 may be configured as a microelectronic or a nanoelectronic device. The electronic device 100 may also be configured to operate as a thermionic converter. In further embodiments, the electronic device 100 may be configured to generate electrical power. For instance, the electronic device 100 may be configured as a vacuum electronic energy conversion device that is configured to convert heat to electricity. Other uses are also contemplated. For example, the electronic device 100 can also be configured to serve as a heat pump or cooler. The electronic device 100 can also be configured to serve as an x-ray source, amplifier, rectifier, switch, display, and/or used in other vacuum electronic applications.

FIG. 2 depicts a perspective view of a portion of the electronic device represented by FIG. 1. More specifically, FIG. 2 depicts a perspective view of a portion of the anode 110 portion of the electronic device. As shown in FIG. 2, the collection surface 114 includes a concave surface 115 that is configured to receive an electron flow. In some embodiments, the concave surface 115 comprises a substantially circular arc with a radius of curvature. In other embodiments, the concave surface 115 comprises a substantially parabolic surface. Other types of concave surfaces are also contemplated. The gate electrode 130 and focus electrode 140 are also depicted and disposed on a support member 150. As further shown in FIG. 2, in some embodiments, the openings 152 comprise elongated slits. In some of such embodiments, the lengths 185 of the openings 152 are greater than their widths 184. Further, the gate and focus electrodes 130, 140 can also be substantially equal in length to the opening 152.

FIG. 3 depicts a perspective view of another portion of the electronic device represented by FIG. 1. More specifically, FIG. 3 depicts a perspective view of a portion of the cathode 120 portion of the electronic device. As shown in FIG. 3, in some embodiments, the cathode 120 can include elongated strips of emitting regions 124. In other embodiments, the emitting regions 124 cover all, or substantially all of the cathode 120.

FIG. 4 depicts a perspective view of a portion of an electronic device 200 in accordance with another embodiment of the present disclosure. More specifically, FIG. 4 depicts a perspective view of a portion of the anode 210 portion of the electronic device 200. As shown in FIG. 4, the collection surface 214 includes a plurality of individual segments 213. Together, the segments 213 form a concave surface 215 that is configured to receive an electron flow.

Figure 5:
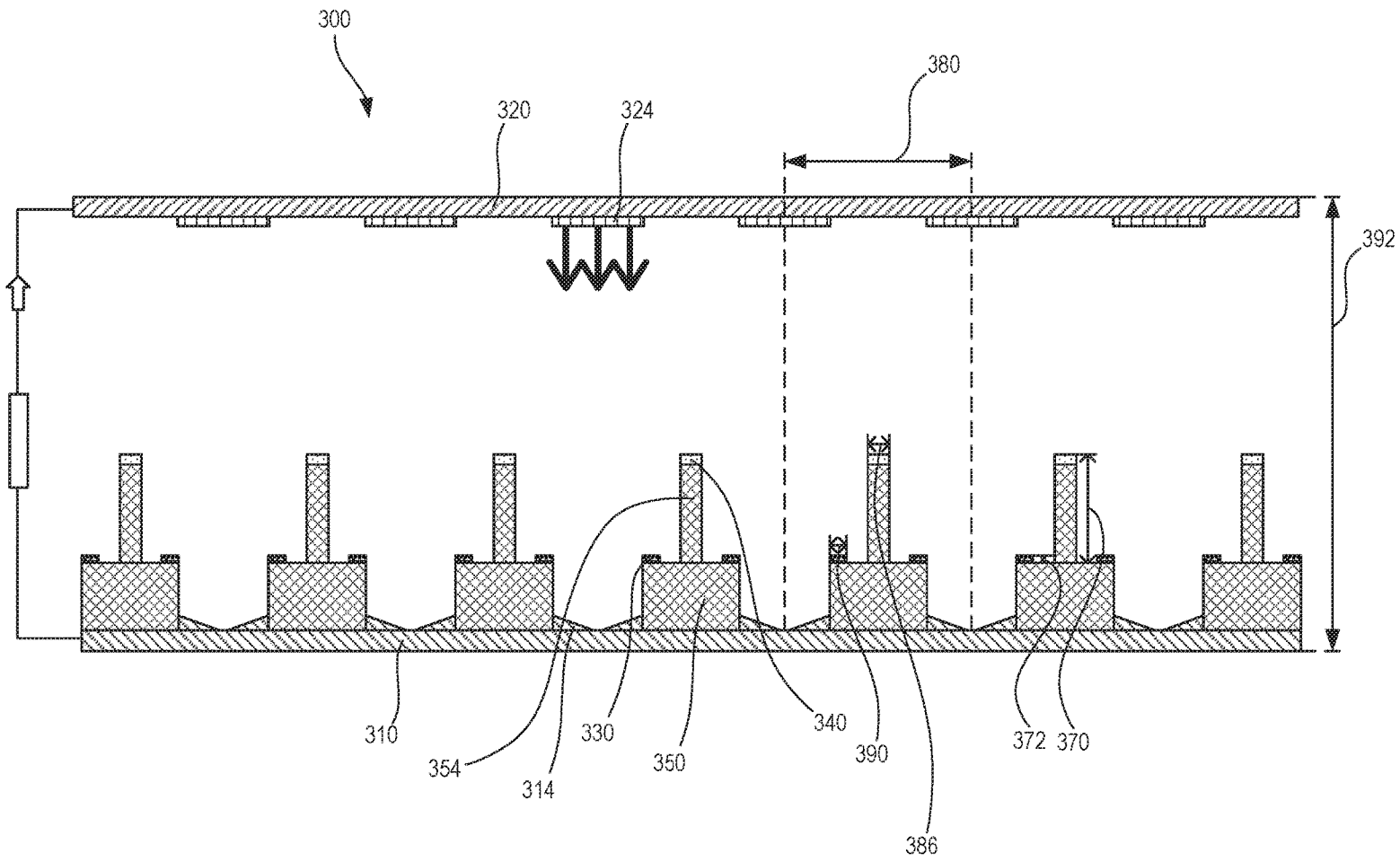
FIG. 5 is a schematic illustration of an electronic device in accordance with another embodiment of the present disclosure.

FIG. 5 is a schematic view of another embodiment of an electronic device 300. The electronic device 300 can, in certain respects, resemble components of the electronic device 100 described in connection with FIG. 1 above. It will be appreciated that the illustrated embodiments may have analogous features. Accordingly, like features are designated with like reference numerals, with the leading digits incremented to "3." (For instance, the electronic device is designated "100" in FIG. 1, and an analogous electronic device is designated as "300" in FIG. 5.) Relevant disclosure set forth above regarding similarly identified features thus may not be repeated hereafter. Moreover, specific features of the electronic device 300 and related components shown in FIG. 5 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the electronic device of FIG. 5. Any suitable combination of the features, and variations of the same, described with respect to the electronic device 100 and components illustrated in FIG. 1, can be employed with the electronic device 300 and components of FIG. 5, and vice versa. This pattern of disclosure applies equally to further embodiments disclosed herein.

FIG. 5 depicts an electronic device 300 according to another embodiment of the present disclosure. As shown in FIG. 5, the electronic device 300 includes an anode 310, a cathode 320, a gate electrode 330 and a focus electrode 340. Moreover, in the embodiment illustrated in FIG. 5, the height 370 of the focus electrode 340 is substantially greater than the height 372 of the gate electrode 330.

In certain instances, having a substantial height difference between the focus electrode 340 and the gate electrode 330 can be advantageous. For example, this configuration may allow for a smaller distance 380 or period between collection regions 314. A smaller distance 380 or period between collection regions 314 can also increase the active area of the anode 310 (or the area that includes collection regions 314). The ratio of collection region 314 to device total area can also increase the power density of the device 300.

As shown in FIG. 5, a smaller period 380 can be obtained with gate and focus electrodes 330, 340 having smaller widths 390, 386. Smaller widths 390, 386 can be made possible by positioning the focus electrode 340 closer to the emitting region 324 of the cathode 320. With the focus electrode 340 closer to the cathode 320, the focusing action of the electron flow can start at a position that is farther from the anode 310. This can also lower the negative electric potential (voltage) required by the focus electrode 330 for proper focusing.

In further embodiments, increasing the height 370 of the focus electrode 340 can aid in producing larger electronic devices 300 (e.g., devices having a relatively large distance 392 between the anode 310 and the cathode 320). Increased height 370 of the focus electrode 340 can be obtained in various ways, including increasing a thickness of the focus electrode 340 and/or increasing a thickness of a portion 354 of the support member 350.

Methods of manufacturing and using the electronic devices are also disclosed herein. In particular, it is contemplated that any of the components, principles, and/or embodiments discussed above may be utilized in either an electronic device or a method of manufacturing and/or using the same. In one embodiment, a method of manufacturing an electronic device includes depositing or disposing one or more emitting regions onto a surface of a cathode substrate. The method can also include a step of depositing or disposing a support member onto a surface of an anode substrate, and forming one or more openings in the support member thereby exposing one or more portions of the anode substrate. The method can further include a step of depositing, disposing, or forming one or more collection regions onto the one or more exposed portions of the anode substrate. In certain instances, the method also includes steps of depositing a gate electrode onto a surface of the support member, and depositing a focus electrode onto the surface of the support member. Other manufacturing steps can also be employed.

Illustrative methods of using the electronic device to collect electrons at an anode can include a step of obtaining an electronic device including a cathode including a cathode substrate and an emitting region that is configured to emit an electron flow; an anode including an anode substrate and a collection region that is configured to receive or absorb the electron flow; a gate electrode disposed between the cathode and the anode, wherein the gate electrode is receptive to a first power source to produce a voltage in the gate electrode; and a focus electrode disposed between the cathode and the anode, wherein the focus electrode is receptive to a second power source to produce a voltage in the focus electrode. The method can further include steps of applying a voltage to the gate electrode that is positively-biased relative to the cathode; and applying a voltage to the focus electrode that is negatively-biased relative to the gate electrode and/or the cathode. The method can also include a step of emitting an electron flow from the emitting region of the cathode, wherein the gate electrode accelerates the electron flow between the cathode and the gate electrode, and wherein the focus electrode forces the electron flow away from the gate electrode and directs and/or steers the electron flow towards the collection region of the anode. Because of the inward force from the electric field of the focus electrode, most electrons will not impact the gate electrode, but instead are steered into the opening and continue moving towards the collection region of the anode (which may include a concave surface). The method can also include a step of collecting the electron flow at the collection region of the anode. For example, electrons having sufficient energy can impact and tunnel into the surface of the collection region. Electrons that do not have sufficient energy to breach the potential barrier of the collection region can still have a high probability of tunneling into the surface of the collection region due to the presence of an electric field at the surface of the collection region. Other steps of using the device can also be employed.

EXAMPLES

The following examples are illustrative of embodiments of the present disclosure, as described above, and are not meant to be limiting in any way.

Example 1

Figure 6:
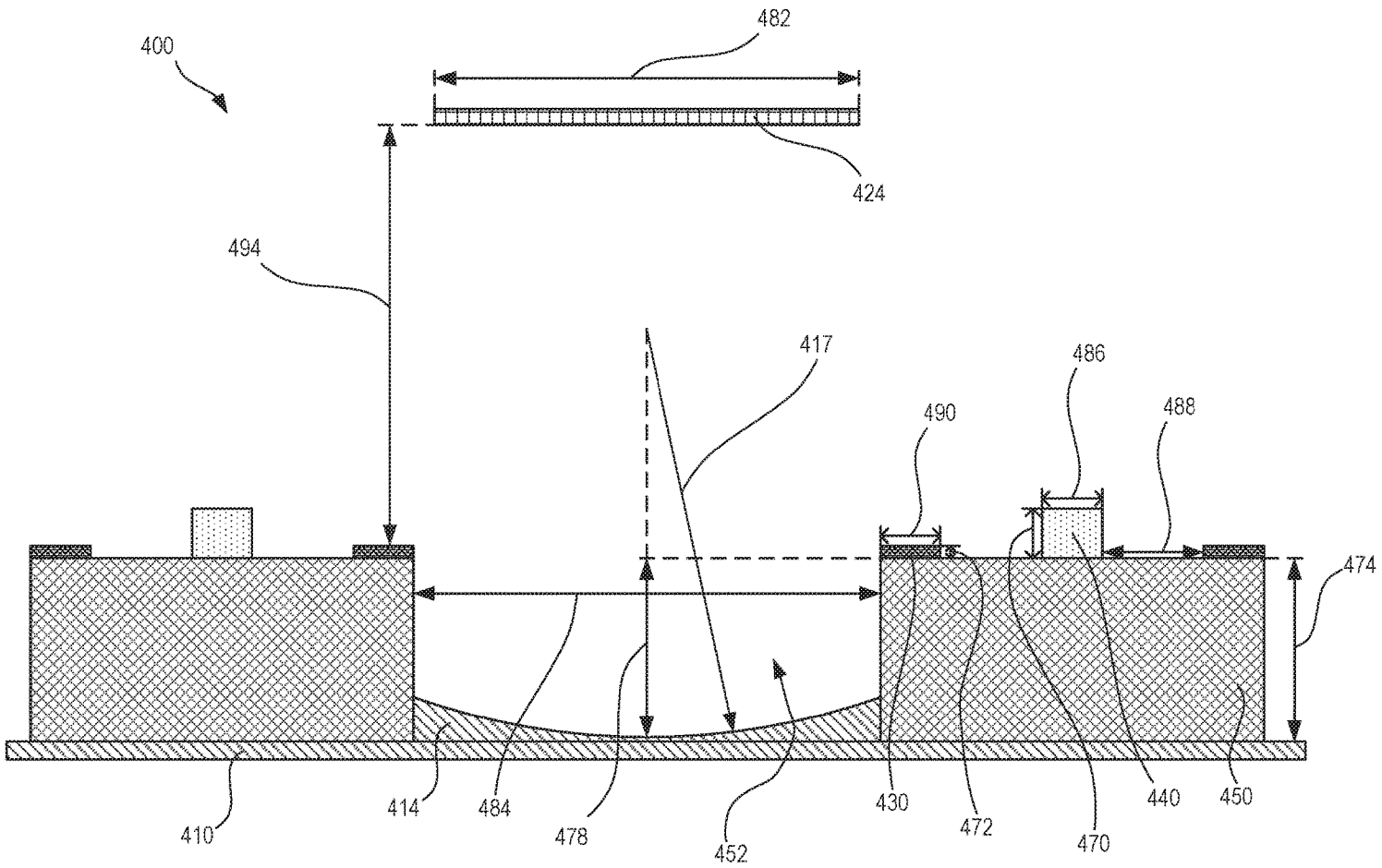
FIG. 6 is a schematic illustration of a portion of an electronic device in accordance with another embodiment of the present disclosure.

FIG. 6 depicts a simulated electronic device 400 designed in accordance with the present disclosure. The parameters of the electronic device 400 are depicted in Table 1 below:

TABLE 1

| Parameter of the Electronic Device | Distance (nm) |
|---|---|
| Width 484 of the opening 452 and/or collection region 414: (The length (not depicted) of the opening 452 was also greater than its width 484.) | 140 nm |
| Radius of curvature 417 of the concave surface of the anode 410: | 180 nm |
| Distance 478 from the collection region 414 to the gate electrode 430: (measured from the center of the collection region 414) | 130 nm |
| Thickness 474 of the support member 450: | 150 nm |
| Thickness 472 of the gate electrode 430: | 5 nm |
| Width 490 of the gate electrode 430: | 30 nm |
| Distance 488 between the gate electrode 430 and the focus electrode 440: | 140 nm |
| Thickness 470 of the focus electrode 440: | 50 nm |
| Width 486 of the focus electrode 440: | 30 nm |
| Distance 494 between the cathode emitting region 424 and the gate electrode 430: | 900-2000 nm |
| Width 482 of the cathode emitting region 424: | 200 nm |
| Period (or distance between adjacent collection regions 414): | 510 nm |

The voltages applied to the electronic device 400 are depicted in Table 2 below:

TABLE 2

| Component of the Electronic Device | Voltage (V) (relative to the Cathode) |
|---|---|
| Cathode | 0 |
| Gate Electrode | +55 |
| Focus Electrode | −30 |
| Anode | −0.5 |

Figure 7:
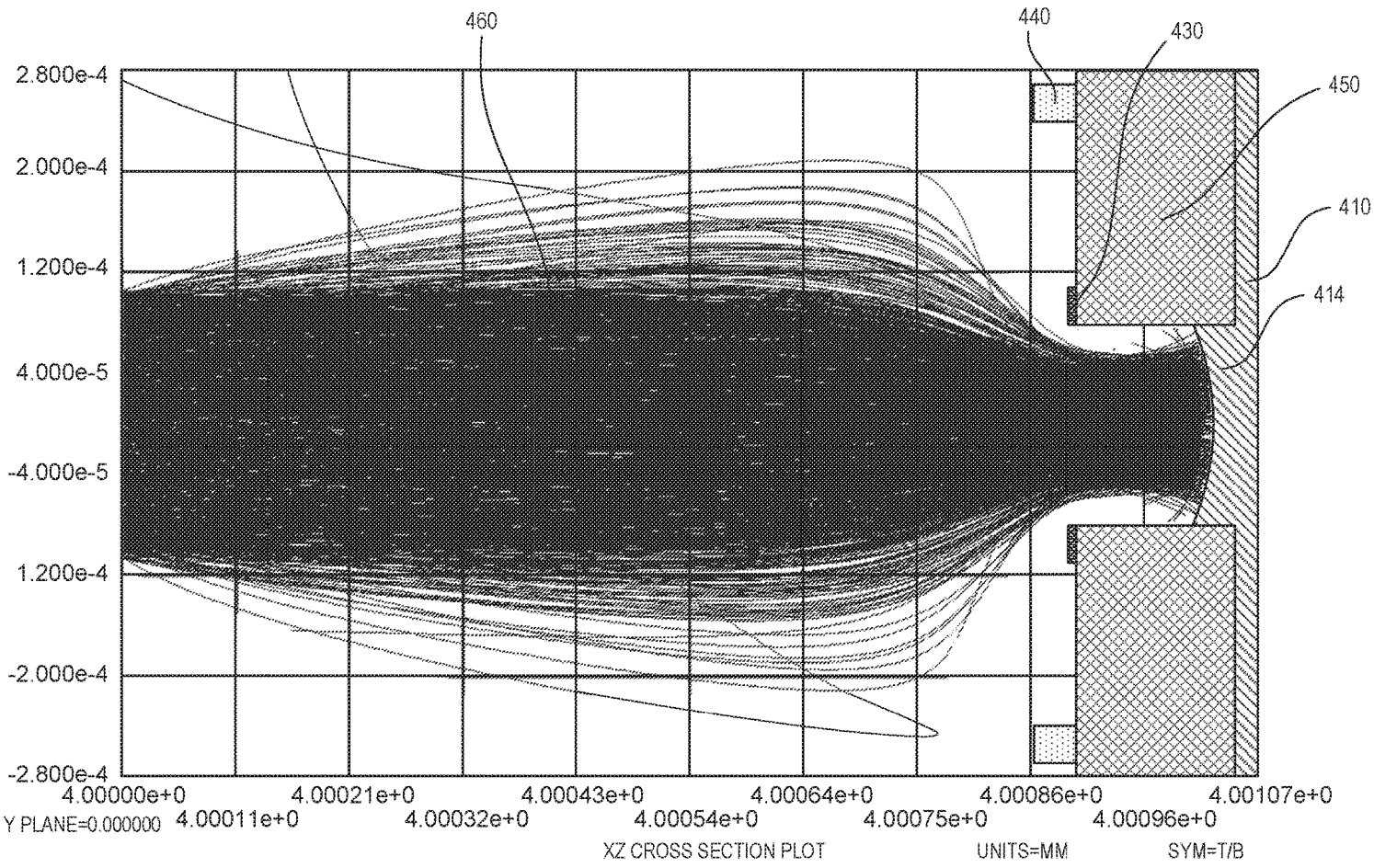
FIG. 7 is a computer simulation depicting operation of the electronic device of FIG. 6.

A computer simulation (using electron optics software from Sci-Comp Scientific Computing) was performed on the electronic device 400 of FIG. 6, using the voltages from Table 2, the results of which are depicted in FIG. 7. More specifically, FIG. 7 depicts the flow 460 or paths of sample electrons traveling through the electric fields of the device 400. In other words, the simulation shows electron trajectories as the electrons travel from the cathode to a collection region 414 of the anode 410 under the influence of the accelerating and focusing electric fields created by the gate electrode 430 and the focus electrode 440 (each of which is supported by a support member 450).

As can be appreciated, the illustrated embodiment of FIGS. 6 and 7 depict one unit of an inverse quantum tunneling device, or one electron flow 460 to one collection region 414. Without limitation, the anode 410 could be composed of many such units (e.g., as depicted in FIGS. 1 and 5).

Example 2

Figure 8:
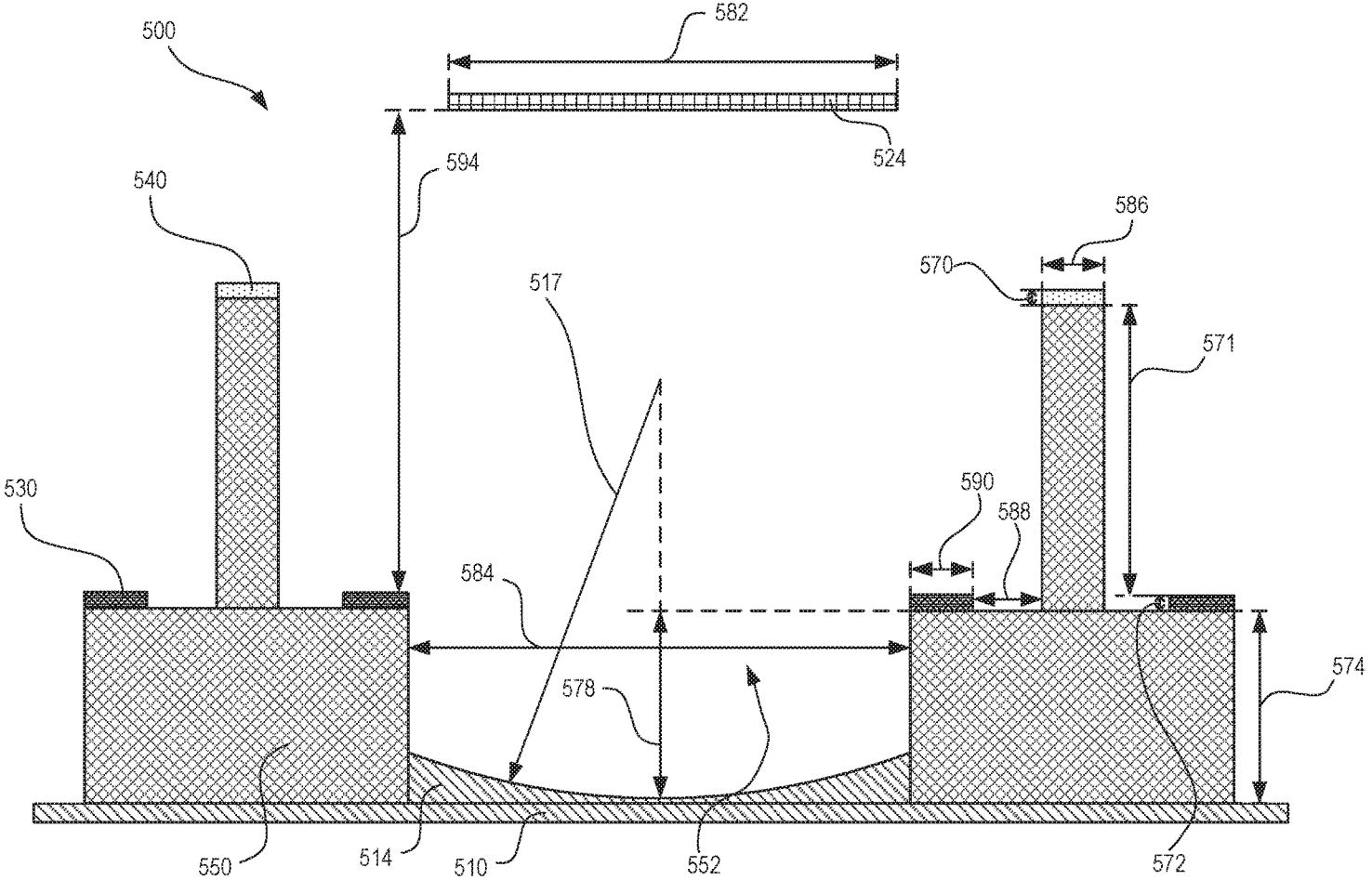
FIG. 8 is a schematic illustration of a portion of an electronic device in accordance with another embodiment of the present disclosure.

FIG. 8 depicts a simulated electronic device 500 designed in accordance with the present disclosure. The parameters of the electronic device 500 are depicted in Table 3 below:

TABLE 3

| Parameter of the Electronic Device | Distance (nm) |
|---|---|
| Width 584 of the opening 552 and/or collection region 514: (The length (not depicted) of the opening 552 was also greater than its width 584.) | 200 nm |
| Radius of curvature 517 of the concave surface of the anode 510: | 180 nm |
| Distance 578 from the collection region 514 to the gate electrode 530: (measured from the center of the collection region 414) | 130 nm |
| Thickness 574 of the support member 550: | 150 nm |
| Thickness 572 of the gate electrode 530: | 20 nm |
| Width 590 of the gate electrode 530: | 30 nm |
| Distance 588 between the gate electrode 530 and the focus electrode 540: | 50 nm |
| Height 571 of the focus electrode 540 above the gate electrode 530: | 150 nm |
| Thickness 570 of the focus electrode 540: | 20 nm |
| Width 586 of the focus electrode 540: | 40 nm |
| Distance 594 between the cathode emitting region 524 and the gate electrode 530: | 900-2000 nm |
| Width 582 of the cathode emitting region 524: | 200 nm |
| Period (or distance between adjacent collection regions 514): | 400 nm |

The voltages applied to the electronic device 500 are depicted in Table 4 below:

TABLE 4

| Component of the Electronic Device | Voltage (V) (relative to the Cathode) |
|---|---|
| Cathode | 0 |
| Gate Electrode | +58 |
| Focus Electrode | −1.5 |
| Anode | 0 |

Figure 9:
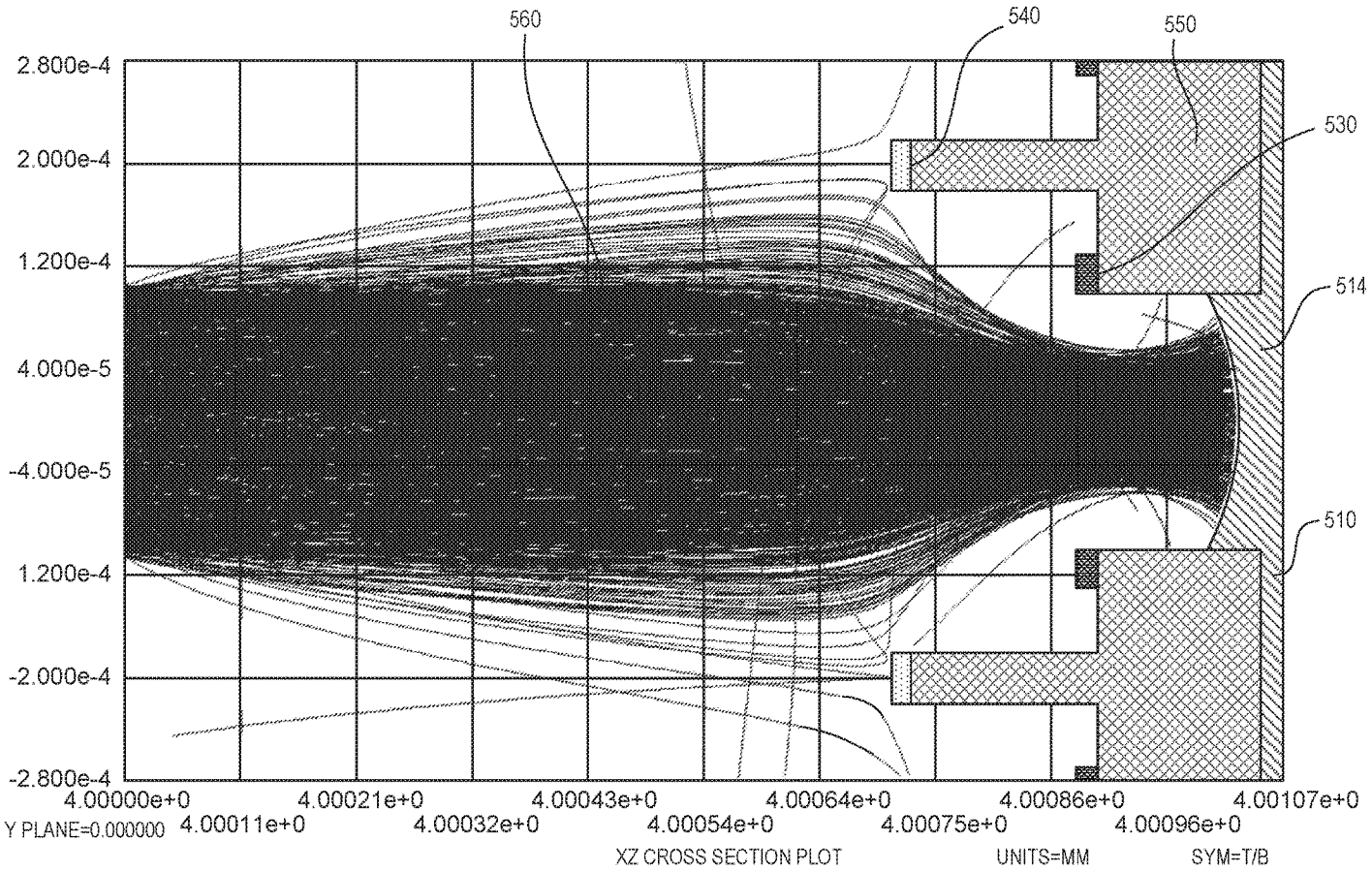
FIG. 9 is a computer simulation depicting operation of the electronic device of FIG. 8.

A computer simulation (using electron optics software from Sci-Comp Scientific Computing) was performed on the electronic device 500 of FIG. 8, using the voltages from Table 4, the results of which are depicted in FIG. 9. More specifically, FIG. 9 depicts the flow 560 or paths of sample electrons traveling through the electric fields of the device 500. In other words, the simulation shows electron trajectories as the electrons travel from the cathode to a collection region 514 of the anode 510 under the influence of the accelerating and focusing electric fields created by the gate electrode 530 and the focus electrode 540 (each of which is supported by a support member 550).

As can be appreciated, the illustrated embodiment of FIGS. 8 and 9 depict one unit of an inverse quantum tunneling device, or one electron flow 560 to one collection region 514. Without limitation, the anode 510 could be composed of many such units (e.g., as depicted in FIGS. 1 and 5).

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment. Additionally, references to ranges include both endpoints.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A vacuum electronic device, comprising:

a cathode comprising a cathode substrate and an emitting region that is configured to emit an electron flow;

an anode comprising an anode substrate and a collection region that is configured to receive the electron flow;

a support member disposed on the anode substrate;

a gate electrode disposed between the cathode and the anode, wherein the gate electrode is receptive to a first power source to produce a voltage in the gate electrode that is positively-biased relative to the cathode;

a focus electrode disposed between the cathode and the anode, wherein the focus electrode is receptive to a second power source to produce a voltage in the focus electrode that is negatively-biased relative to the gate electrode, wherein each of the gate electrode and the focus electrode is disposed on the support member.

2. The device of claim 1, wherein the focus electrode is negatively-biased relative to the cathode.

3. The device of claim 1, wherein the gate electrode is configured to accelerate the electron flow between the cathode and the gate electrode, and wherein the focus electrode is configured to force the electron flow away from the gate electrode.

4. The device of claim 1, wherein the voltage in the gate electrode is positively-biased relative to the anode, and wherein the gate electrode is configured to decelerate the electron flow between the gate electrode and the anode.

5. The device of claim 1, wherein the collection region comprises a concave surface.

6. The device of claim 5, wherein the concave surface comprises a substantially smooth, curved concave surface.

7. The device of claim 5, wherein the concave surface comprises a plurality of individual segments.

8. The device of claim 5, wherein an electric field is configured to cause the electron flow to impact the collection region at a substantially perpendicular angle.

9. The device of claim 1, wherein the emitting region of the cathode is aligned with the collection region of the anode.

10. The device of claim 1, wherein the cathode comprises a plurality of emitting regions, and wherein the anode comprises a plurality of collection regions, wherein the plurality of emitting regions are aligned with the plurality of collection regions.

11. The device of claim 1, wherein the vacuum electronic device is a vacuum electronic energy conversion device.

12. The device of claim 1, wherein the cathode is a thermionic cathode.

13. The device of claim 1, wherein the cathode substrate and the anode substrate are separated by a distance of less than about 500 microns.

14. The device of claim 1, wherein the support member comprises one or more openings, wherein the openings are aligned with the collection region of the anode.

15. The device of claim 14, wherein the one or more openings each comprise an elongated slit, wherein a length of the slit is larger than the width of the slit.

16. The device of claim 1, wherein a thickness of the focus electrode is greater than a thickness of the gate electrode.

17. The device of claim 1, wherein the gate electrode is disposed closer to the opening than the focus electrode.

18. The device of claim 1, wherein the anode comprises tungsten, tantalum, lanthanum, lanthanum hexaboride, cerium, cerium hexaboride, barium, barium carbonate, barium oxide, cesium, silicon, doped silicon, or a mixture thereof.

19. The device of claim 1, wherein the cathode comprises tungsten, tantalum, molybdenum, rhenium, osmium, platinum, nickel, lanthanum, lanthanum hexaboride, cerium, cerium hexaboride, barium, barium carbonate, barium oxide, cesium, or a mixture thereof.

20. The device of claim 1, wherein the gate electrode comprises aluminum, molybdenum, tungsten, nickel, copper, platinum, gold, carbon nanotubes, graphene, or a mixture thereof.

21. The device of claim 1, wherein the vacuum electronic device is a vacuum electronic energy conversion device.

22. The device of claim 1, wherein the support member comprises an insulating material, wherein the insulating material comprises silicon, silicon nitride, silicon oxide, aluminum oxide, or a mixture thereof.

23. A method of manufacturing an electronic device, comprising:

forming a cathode comprising a cathode substrate;

forming an anode comprising an anode substrate;

disposing an emitting region onto a surface of the cathode substrate, the emitting region to emit an electron flow;

disposing a support member onto a surface of the anode substrate;

forming an opening in the support member to expose a portion of the anode substrate;

forming a collection region onto the exposed portion of the anode substrate, the collection region to receive the electron flow;

disposing a gate electrode onto a surface of the support member, wherein the gate electrode is receptive to a first power source to produce a voltage in the gate electrode that is positively-biased relative to the cathode; and disposing a focus electrode onto the surface of the support member, wherein the focus electrode is receptive to a second power source to produce a voltage in the focus electrode that is negatively-biased relative to the gate electrode.

24. The method of claim 23, further comprising aligning the emitting region with the collection region.

25. The method of claim 23, wherein forming the anode substrate comprises forming the anode substrate from tungsten, tantalum, lanthanum, lanthanum hexaboride, cerium, cerium hexaboride, barium, barium carbonate, barium oxide, cesium, silicon, doped silicon, or a mixture thereof.

26. The method of claim 23, wherein forming the cathode substrate comprises forming the cathode substrate from tungsten, tantalum, molybdenum, rhenium, osmium, platinum, nickel, lanthanum, lanthanum hexaboride, cerium, cerium hexaboride, barium, barium carbonate, barium oxide, cesium, or a mixture thereof.

27. The method of claim 23, wherein disposing the support member comprises disposing an insulating material comprising silicon, silicon nitride, silicon oxide, aluminum oxide, or a mixture thereof.

28. The method of claim 23, wherein disposing the gate electrode comprises disposing the gate electrode so as to accelerate the electron flow between the cathode and the gate electrode, and wherein disposing the focus electrode comprises disposing the focus electrode so as to force the electron flow away from the gate electrode.

29. The method of claim 23, wherein the voltage in the gate electrode is positively-biased relative to the anode, and wherein disposing the gate electrode comprises disposing the gate electrode so as to decelerate the electron flow between the gate electrode and the anode.

30. The method of claim 23, wherein forming the collection region comprises forming the collection region as a concave surface.

31. The method of claim 30, wherein forming the collection religion as a concave surface comprises forming the concave surface as a substantially smooth, curved concave surface.

32. The method of claim 30, wherein forming the collection region as a concave surface comprises forming the concave surface as a plurality of individual segments.

33. The method of claim 23, wherein disposing the gate electrode comprises disposing the gate electrode closer to the opening than the focus electrode.

34. A method of collecting electrons at an anode, comprising:

obtaining a vacuum electronic energy conversion device comprising:

a cathode comprising a cathode substrate and an emitting region that is configured to emit an electron flow;

an anode comprising an anode substrate and a collection region that is configured to receive the electron flow;

a support member disposed on the anode substrate;

a gate electrode disposed between the cathode and the anode, wherein the gate electrode is receptive to a first power source to produce a voltage in the gate electrode; and a focus electrode disposed between the cathode and the anode, wherein the focus electrode is receptive to a second power source to produce a voltage in the focus electrode;

wherein each of the gate electrode and the focus electrode is disposed on the support member;

applying a voltage to the gate electrode that is positively-biased relative to the cathode;

applying a voltage to the focus electrode that is negatively-biased relative to the gate electrode;

emitting an electron flow from the emitting region of the cathode, wherein the gate electrode accelerates the electron flow between the cathode and the gate electrode, and wherein the focus electrode forces the electron flow away from the gate electrode; and collecting the electron flow at the collection region of the anode.

35. The method of claim 34, wherein the voltage applied to the gate electrode is positively-biased relative to the anode such that the gate electrode decelerates the electron flow between the gate electrode and the anode.

* * * * *